US011073264B1

(12) United States Patent
Gong

(10) Patent No.: US 11,073,264 B1
(45) Date of Patent: Jul. 27, 2021

(54) BATTERY CLAMP STRUCTURE OF DETACHABLE LIGHTING LAMP

(71) Applicant: Jiunn-Ren Gong, Hsinchu (TW)

(72) Inventor: Jiunn-Ren Gong, Hsinchu (TW)

( * ) Notice: Subject to any disclaimer, the term of this patent is extended or adjusted under 35 U.S.C. 154(b) by 0 days.

(21) Appl. No.: 17/096,372

(22) Filed: Nov. 12, 2020

(30) Foreign Application Priority Data

Jan. 7, 2020 (TW) ..... 109200210

(51) Int. Cl.

| | |
|---|---|
| ***F21V 8/00*** | (2006.01) |
| ***F21V 21/088*** | (2006.01) |
| ***H01R 11/24*** | (2006.01) |
| ***F21V 21/084*** | (2006.01) |
| ***F21V 23/04*** | (2006.01) |

(52) U.S. Cl.
CPC ..... *F21V 21/088* (2013.01); *F21V 21/084* (2013.01); *F21V 23/04* (2013.01); *H01R 11/24* (2013.01); *F21V 21/0885* (2013.01); *F21V 23/0414* (2013.01)

(58) Field of Classification Search
CPC .... F21V 21/08; F21V 21/088; F21V 21/0885; F21V 21/084; F21V 23/04; F21V 23/0414; H01R 11/24; H01R 11/22
See application file for complete search history.

(56) References Cited

U.S. PATENT DOCUMENTS

| | | | | |
|---|---|---|---|---|
| 5,420,767 | A * | 5/1995 | Jones | F21L 15/14 362/109 |
| 6,206,543 | B1 * | 3/2001 | Henry | F21V 21/084 362/105 |
| 6,896,544 | B1 * | 5/2005 | Kuelbs | H01R 11/24 362/253 |
| 2013/0099736 | A1 * | 4/2013 | Roberts | H01R 11/24 362/253 |
| 2017/0315385 | A1 * | 11/2017 | Chung | F21V 21/0885 362/253 |

* cited by examiner

*Primary Examiner* — Y M. Quach Lee
(74) *Attorney, Agent, or Firm* — Chun-Ming Shih; Lanway IPR Services

(57) ABSTRACT

A battery clamp structure of detachable lighting lamp includes at least a battery clamp and a lamp, wherein the battery clamp includes two oppositely installed grips, with one end of each of the grips respectively having a clamp head, and the exterior of a clamp head is configured with a slide groove; in addition, the lamp includes a lighting portion, a switch and a clamp; accordingly, the clamp can be detachably assembled within the slide groove such that the lamp and the clamp head can be fixedly assembled, and, when the lamp is fixed onto the clamp head, the lighting portion faces towards the clamp head thus allowing the lighting portion to cast light at the direction of the clamp head.

10 Claims, 12 Drawing Sheets

BATTERY CLAMP STRUCTURE OF DETACHABLE LIGHTING LAMP

BACKGROUND OF THE INVENTION

1. Field of the Invention

The present invention generally relates to a battery clamp structure of detachable lighting lamp which can be applied to clamp on a vehicle battery as a tool for vehicle activation power source.

2. Description of Related Art

It is quite common that the car battery may run out of power. Typically, this problem may be smoothly solved through various road rescue services or the assistance of a third person at the moment of the incident, whose solutions are usually transferring required electrical energy into the battery of the vehicle directly by means of a battery clamp (commonly referred as the "alligator clamp").

However, in case the incident occurs in the evening or late nighttime, and it is outdoors where public lighting is lacking, due to such illumination insufficiency, extra lighting means need to be provided thereby helping complete the charging operation, which may become quite inconvenient and troublesome.

In addition, although the battery clamp structure having embedded lamps has been developed, the lamp is fixedly embedded onto the battery clamp, indicating that the illumination direction is only restricted to the front or around the battery clamp, which undesirably limits the application function, thus unable to enable flexible operations.

Therefore, the present invention is configured to allow the lamp to be detachably assembled with the battery clamp in order to facilitate the disassembly of the lamp to meet more lighting needs, which is the solution offered by the present invention.

SUMMARY OF THE INVENTION

The present invention discloses a battery clamp structure of detachable lighting lamp, comprising a battery clamp and a lamp, wherein the battery clamp includes two oppositely installed grips, with one end of each of the grips respectively having a clamp head, and wherein the exterior of a clamp head is configured with a slide groove, the end of the slide groove towards the direction of the clamp head is formed with an abutting end, and the two sides of the slide groove respectively have a protruding rail; in addition, the lamp includes a lighting portion, a switch and a clamp, in which the end of the clamp towards the same side as the lighting portion is formed with a raised segment, the two sides of the raised segment are respectively configured with a recess portion, and a gripping segment close to the lamp is formed in extension from the raised segment; accordingly, the clamp can be detachably assembled within the slide groove such that, upon assembling, the raised segment can be embedded into the slide groove from the exterior thus allowing each protruding rail to be embedded into the recess portion in order to let the clamp slide therein along the protruding rail and then slide to the abutting end at the raised segment to be fixed in place, and, when the lamp is fixed onto the clamp head, the lighting portion faces towards the clamp head thus allowing the lighting portion to cast light at the direction of the clamp head.

In a preferred embodiment, each of the clamp heads is inclined at a predetermined angle from one end of each of the grips such that an angle can be formed between each clamp head and each grip.

In a preferred embodiment, the bottom of the slide groove is configured to be inwardly inclined with respect to the abutting end such that the raised segment is attached to the inclined bottom of slide groove when the clamp is assembled inside the slide groove.

In a preferred embodiment, the bottom of the slide groove includes a snap fixation groove and a tail segment is outwardly formed in extension from the gripping segment, such that the tail segment is snapped into the snap fixation groove for fixation when the clamp is assembled inside the slide groove.

In a preferred embodiment, two battery clamps are configured, and each battery clamp is respectively connected to a wire which is further installed with a controller.

In a preferred embodiment, two battery clamps are configured, and each wire is connected to a battery installed on another vehicle or a power bank of any style.

In a preferred embodiment, two battery clamps are configured as a set, with one of such two battery clamps having the slide groove, or otherwise, both of such two battery clamps having the slide groove.

DETAILED DESCRIPTION OF THE PREFERRED EMBODIMENTS

Figure 1:
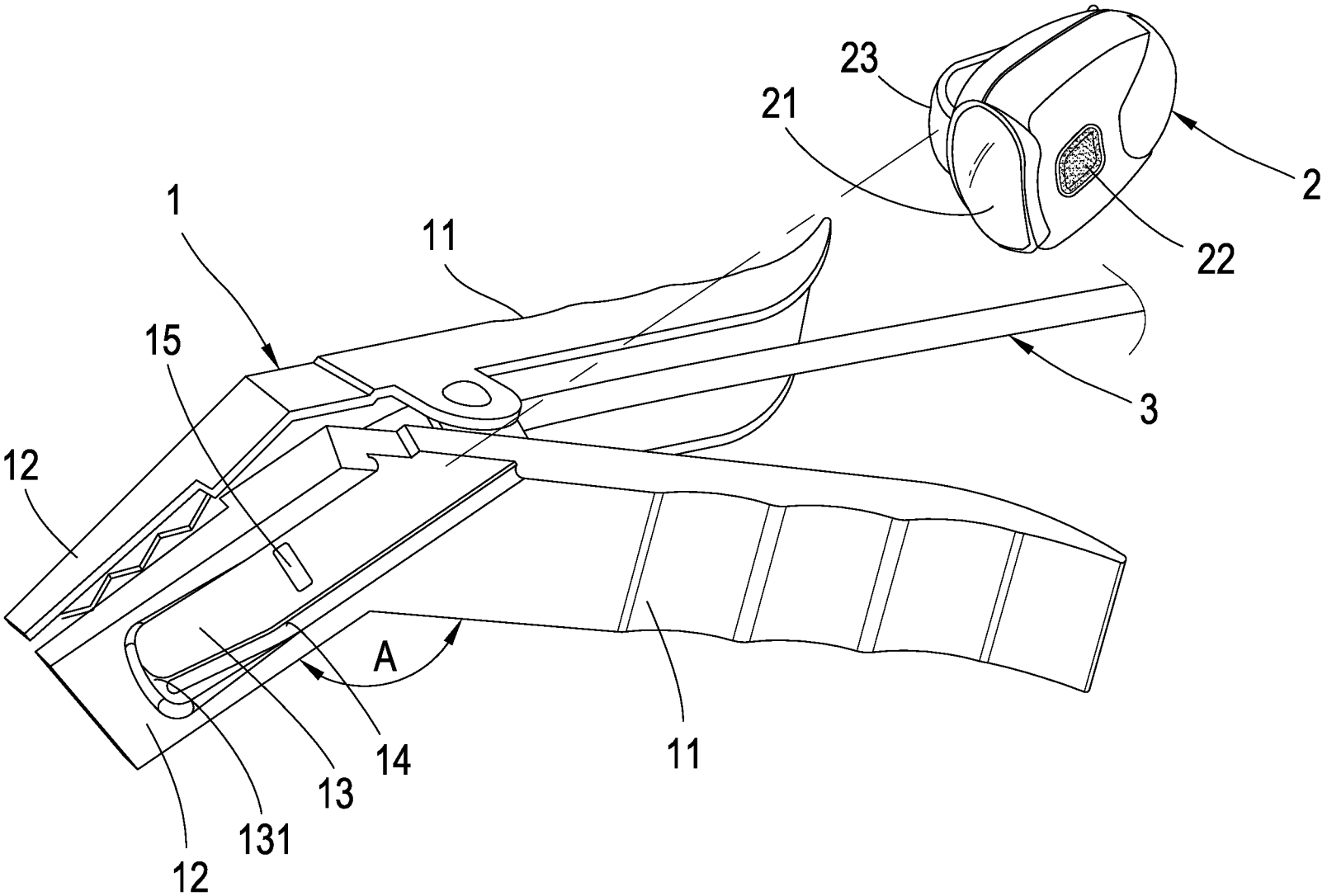
FIG. 1 shows a stereo disassembly view of the battery clamp structure according to the present invention.
Figure 2A:
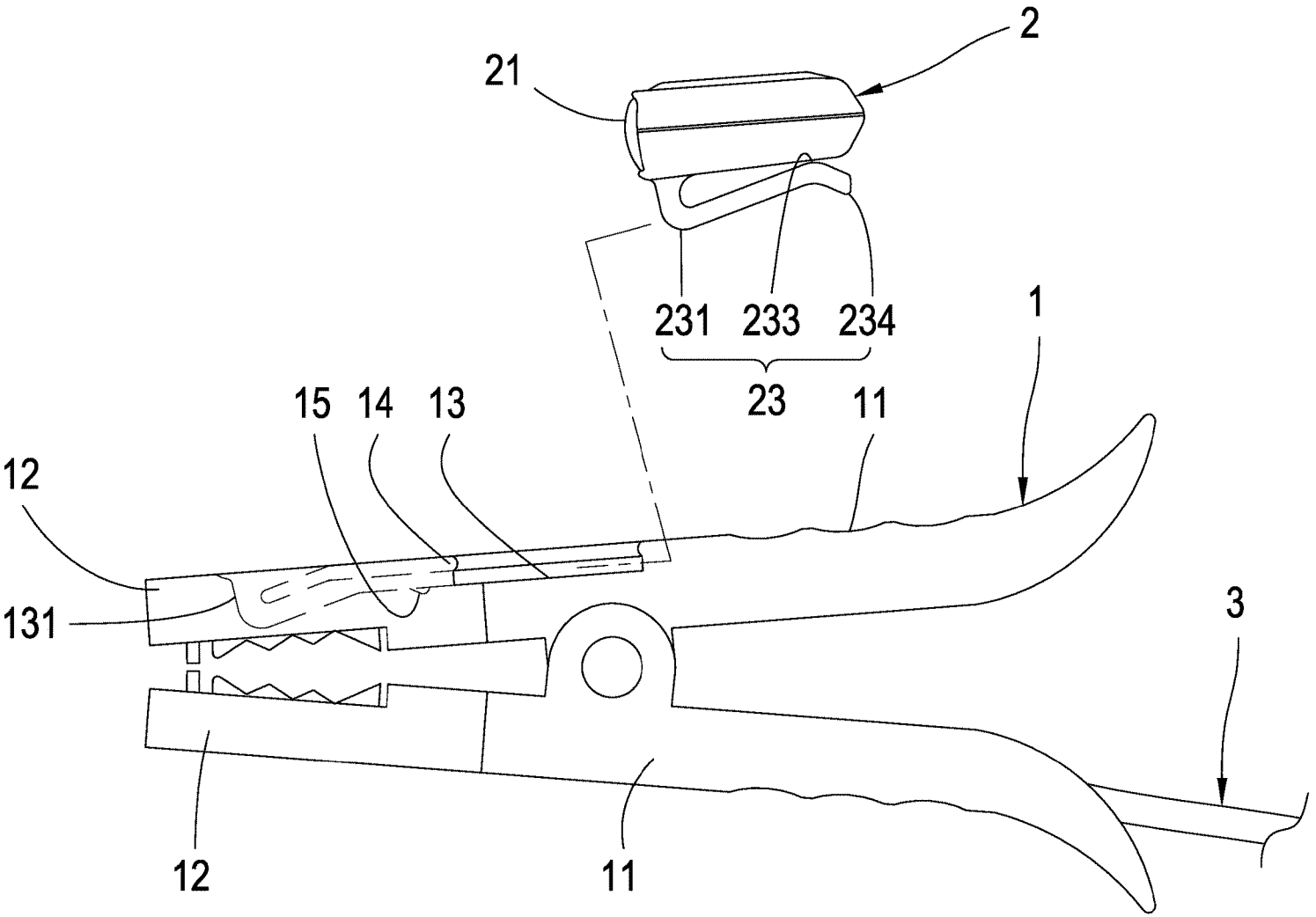
FIG. 2A shows a planar disassembly view of the battery clamp structure according to the present invention.
Figure 2B:
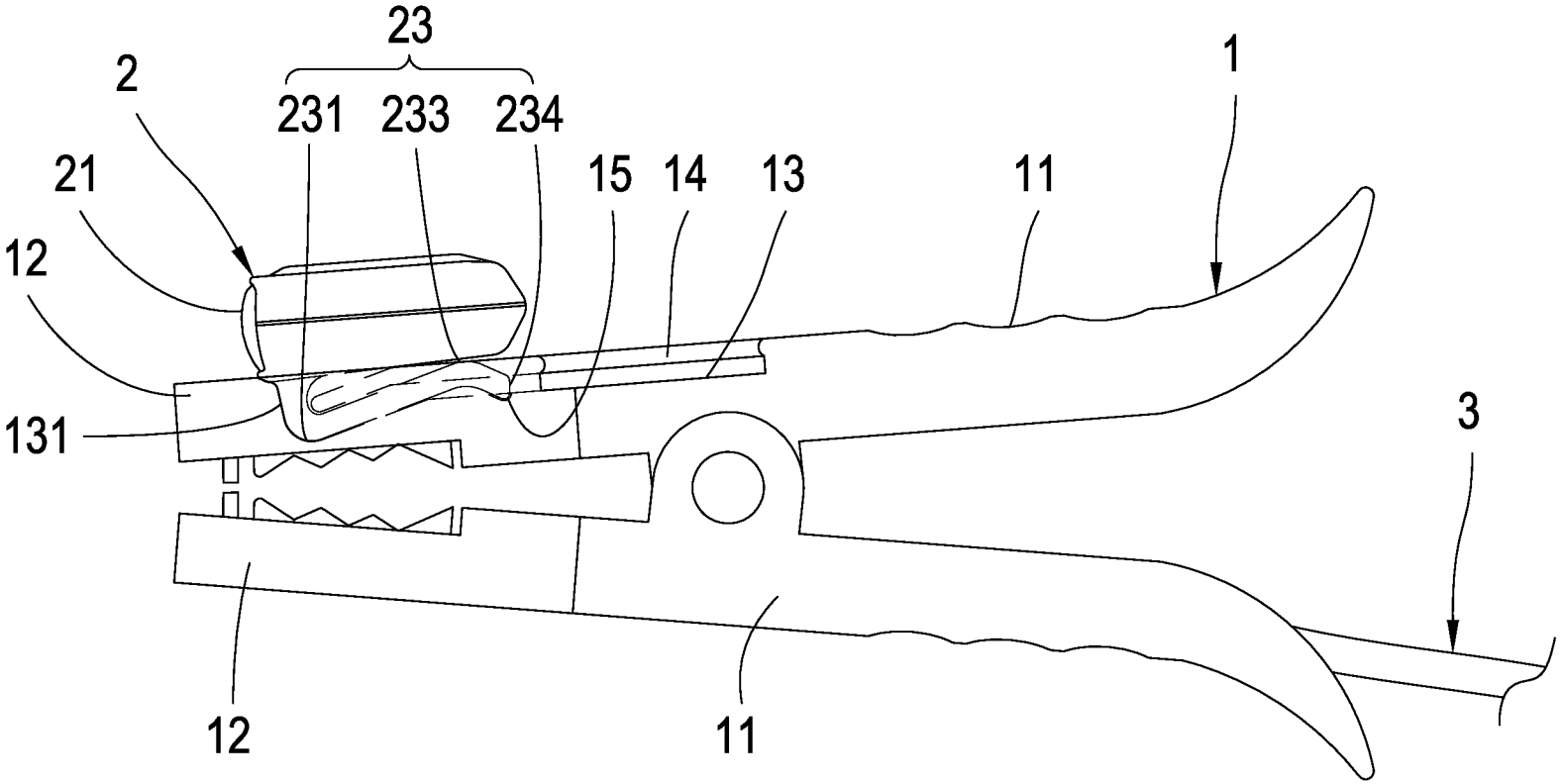
FIG. 2B shows a planar view of the battery clamp structure according to the present invention.
Figure 3:
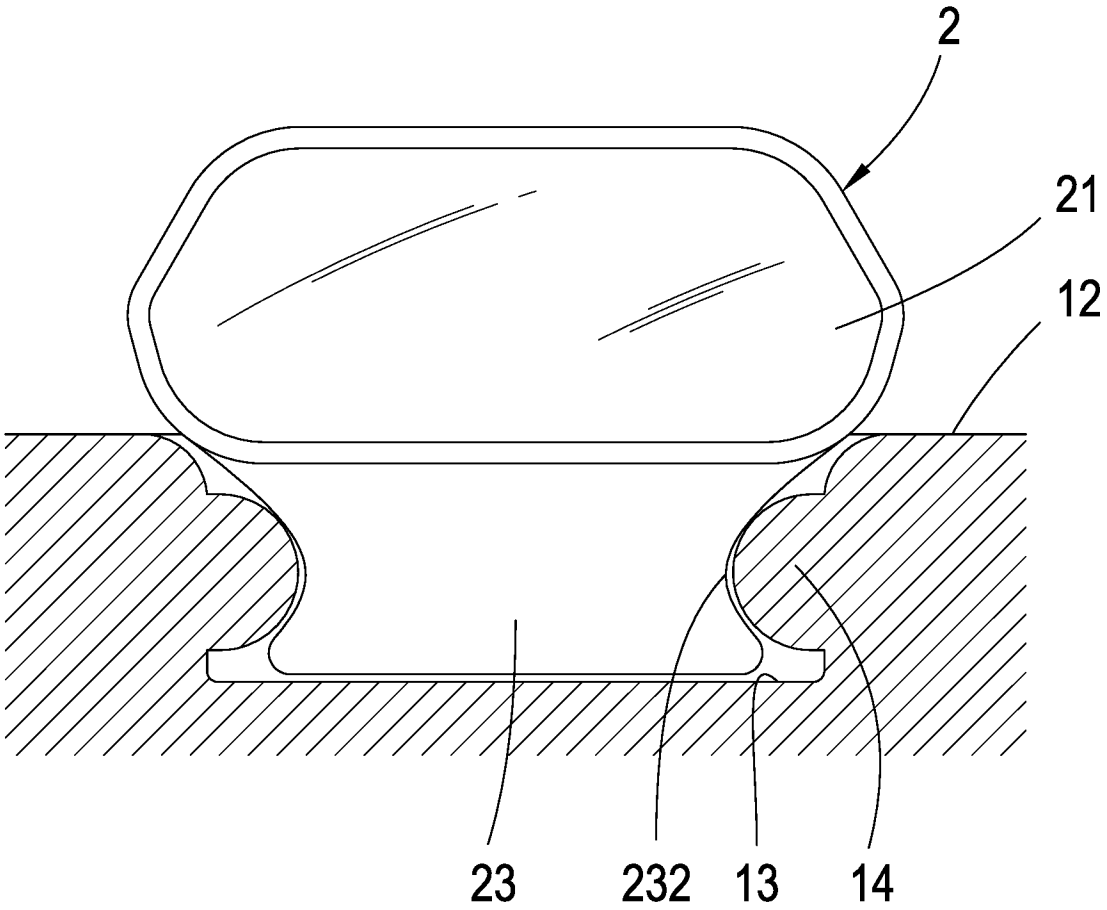
FIG. 3 shows a partial cross-section view of the battery clamp structure according to the present invention.

Other technical contents, aspects and effects concerning the present invention can be clearly appreciated through the detailed descriptions on the preferred embodiments of the present invention in conjunction with the appended drawings.

Refer first to FIGS. 1, 2A, 2B and 3, wherein a stereo disassembly view, a planar view and an inner structure cross-section view of the battery clamp structure of detachable lighting lamp according to the present invention are respectively shown, comprising at least a battery clamp 1 and a lamp 2.

Herein, the battery clamp 1 includes two opposite grips 11, and one end of each of such grips 11 respectively has a clamp head 12 inclined at a predetermined angle such that an angle A can be formed between each clamp head 12 and each grip 11. In addition, the exterior of a clamp head 12 is openly configured with a slide groove 13, the end of the slide groove 13 towards the direction of the clamp head 12 is formed with an abutting end 131, and the bottom of the slide groove 13 is configured to be inwardly inclined with respect to the abutting end 131; also, the two sides of the slide groove 13 respectively have a protruding rail 14, and the bottom of the slide groove 13 is recessively configured with a snap fixation groove 15.

Besides, the lamp 2 includes a lighting portion 21, a switch 22 and a clamp 23, in which the end of the clamp 23 towards the same side as the lighting portion 21 is formed with a raised segment 231, the two sides of the raised segment 231 are respectively configured with a recess portion 232, a gripping segment 233 close to the lamp 2 is formed in extension from the raised segment 231, and a tail segment 234 is further outwardly formed in extension from the gripping segment 233.

Accordingly, the clamp 23 can be detachably assembled within the slide groove 13 such that, upon assembling, the raised segment 231 can be embedded into the slide groove 13 from the exterior thus allowing each protruding rail 14 to be embedded into the recess portion 232 in order to let the clamp 23 slide therein along the protruding rail 14 and also slide to the abutting end 131 at the raised segment 231; in addition, the raised segment 231 can be attached to the inwardly inclined bottom of the slide groove 13 and the tail segment 234 can be snapped into the snap fixation groove 15, thus completing the assembling and fixing operations of the lamp 2 on the clamp head 12.

Figure 4:
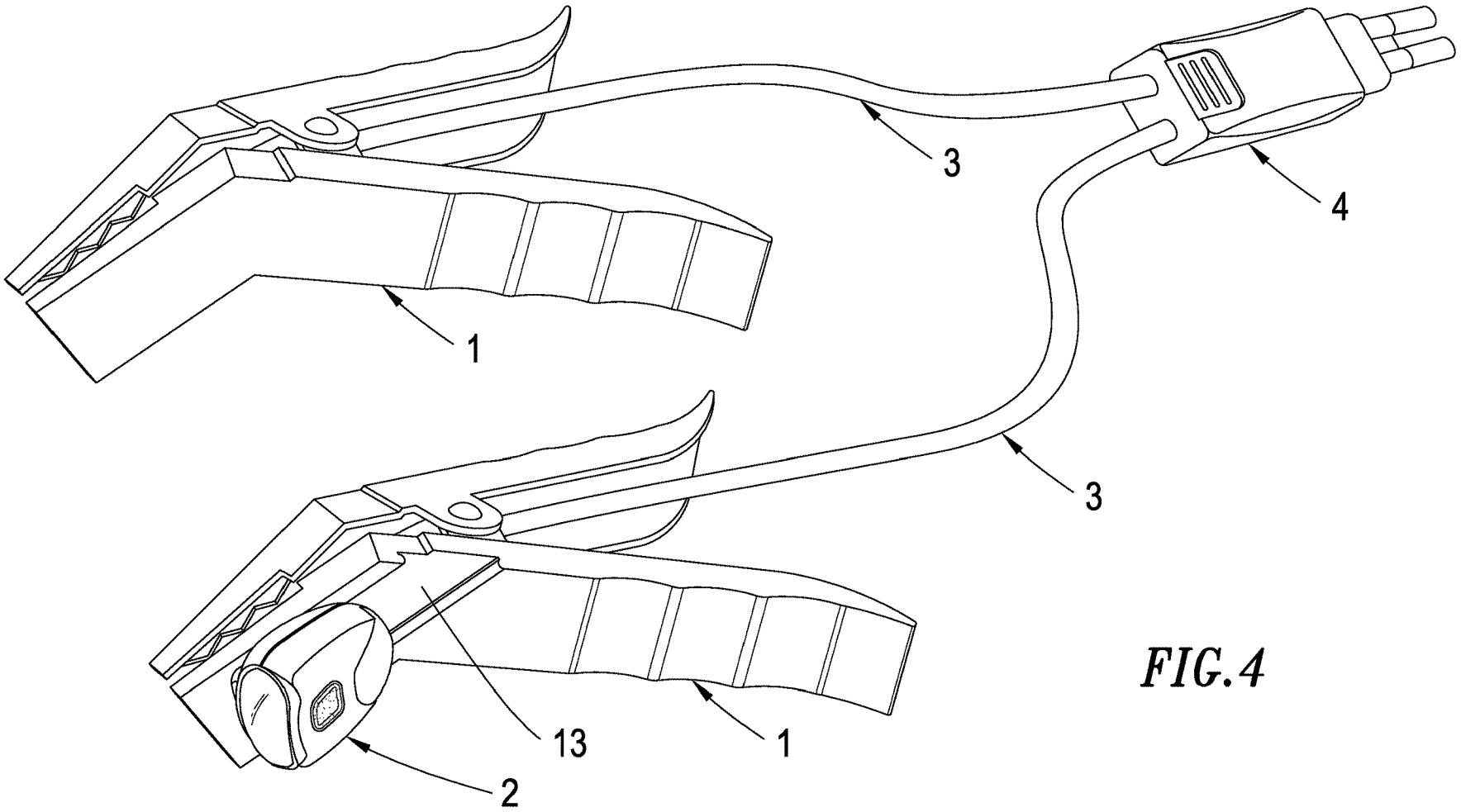
FIG. 4 shows a stereo view of the battery clamp structure according to the present invention, which is installed with a controller.

Refer next to FIG. 4 which shows a battery clamp structure of detachable lighting lamp according to the present invention, wherein two battery clamps 1 are installed, each of such battery clamps 1 is respectively connected to a wire 3, each wire is connectively installed within the clamp head 12 not being openly configured with the slide groove 13, and each wire 3 is set up with a controller 4.

Figure 5:
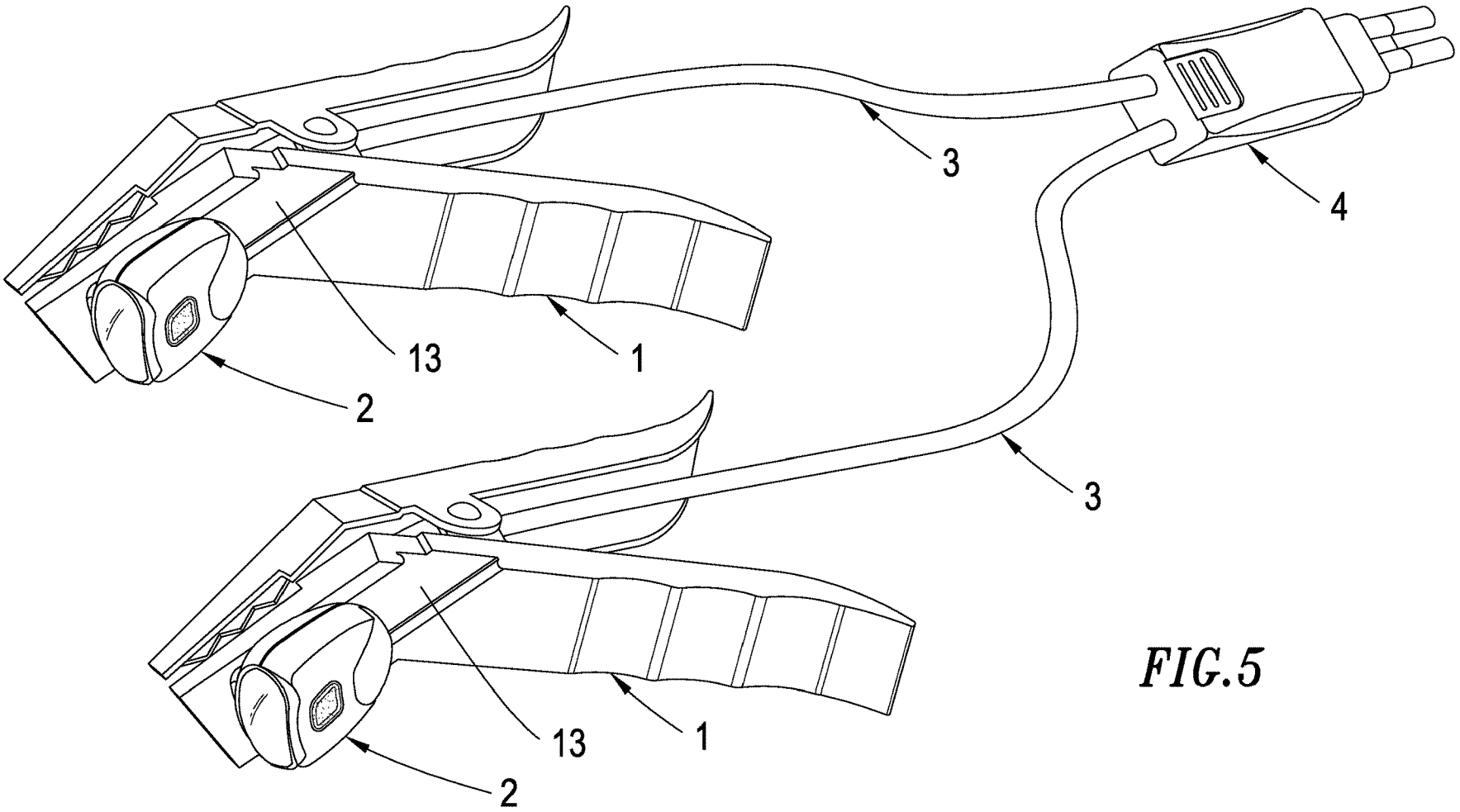
FIG. 5 shows a stereo view of the battery clamp structure according to the present invention, which is installed with a controller.

In the battery clamp structure of detachable lighting lamp according to the present invention shown in FIG. 4, it can be seen that the two battery clamps 1 are configured to be a set, each battery clamp 1 is respectively connected to a wire 3 and each of such wires 3 can be connectible at the end thereof; also, one of the battery clamps 1 includes a slide groove 13 to allow the installation of the lamp 2, as shown in FIG. 5; or otherwise, both of such two battery clamps 1 can be configured with a slide groove 13 to allow the installation of the lamp 2.

Figure 6A:
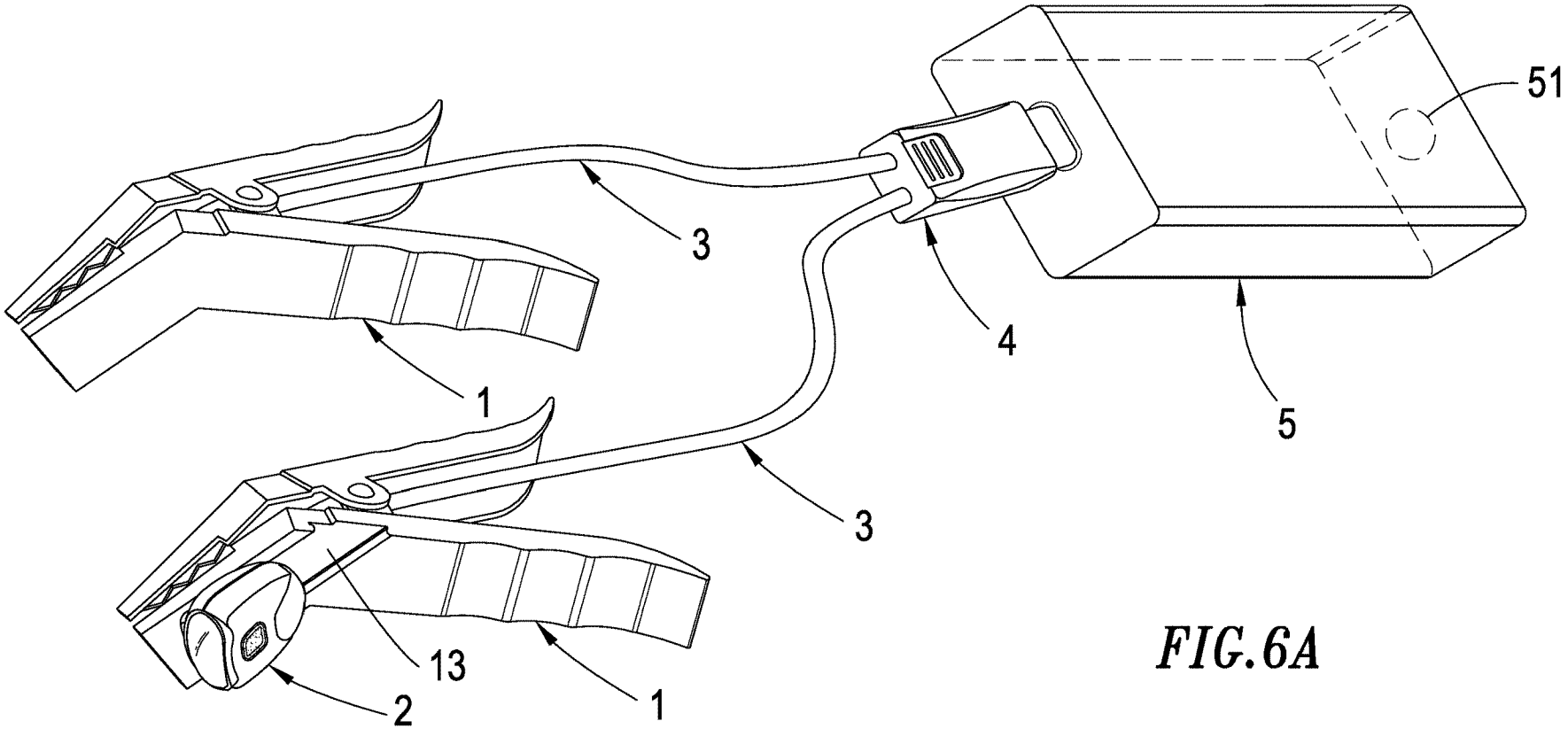
FIG. 6A shows a stereo view of the battery clamp structure according to the present invention, which is installed with a power bank.
Figure 6B:
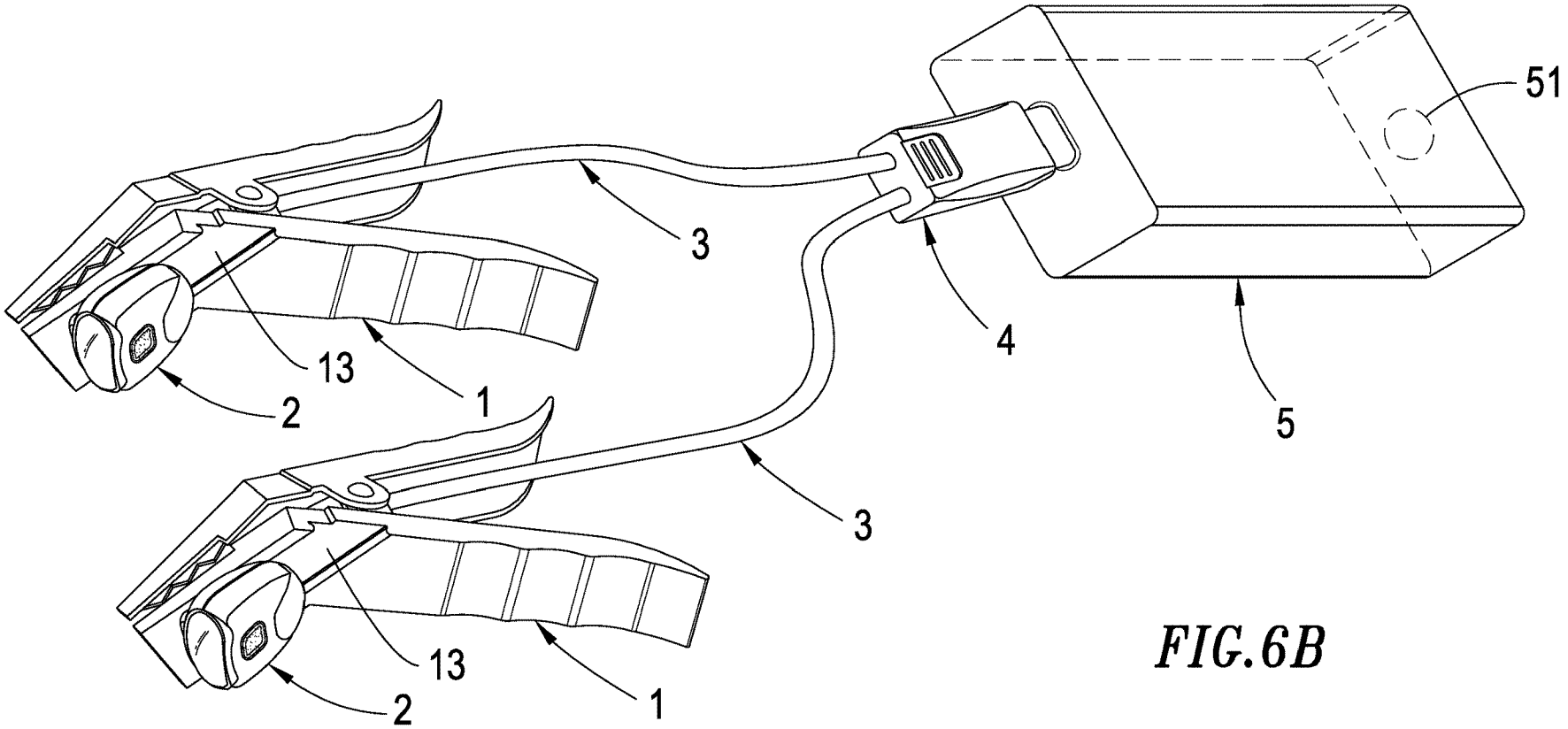
FIG. 6B shows a stereo view of the battery clamp structure according to the present invention, which is installed with a power bank.

Subsequently, refer to FIG. 6A which shows a battery clamp structure of detachable lighting lamp according to the present invention, wherein two battery clamps 1 are installed, one of such two battery clamps 1 is configured with a slide groove 13 to allow installation of the lamp 2, each of such battery clamps 1 is respectively connected to a wire 3, and each of such wire 3 may be connected to a battery installed on another vehicle or a power bank 5 of any style; additionally, the power bank 5 may further include a light-emitting component 51 which can operate conjunctively with the lamp 2 in order to satisfy a broader range of omnidirectional lighting needs. Or alternatively, referring to FIG. 6B, it can seen that both of such two battery clamps 1 can be configured with a slide groove 13 to allow the installation of the lamp 2.

In the battery clamp structure of detachable lighting lamp according to the present invention shown in FIG. 1, it can be observed that the switch 22 is made of luminous material, so the position of the switch 22 can be quickly found at night or in an environment without sufficient illumination.

Figure 7:
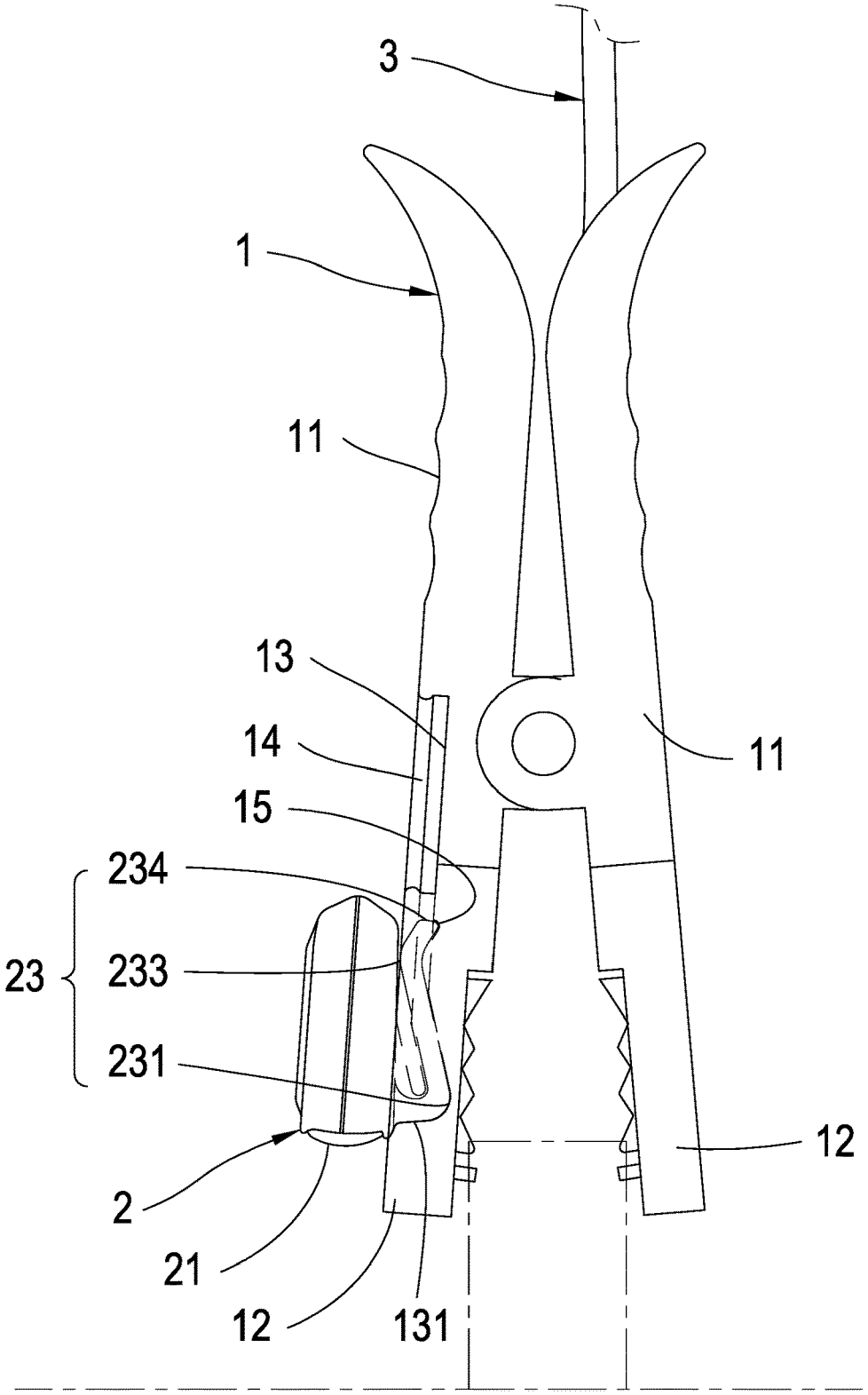
FIG. 7 shows an application view of the battery clamp structure according to the present invention.
Figure 8A:
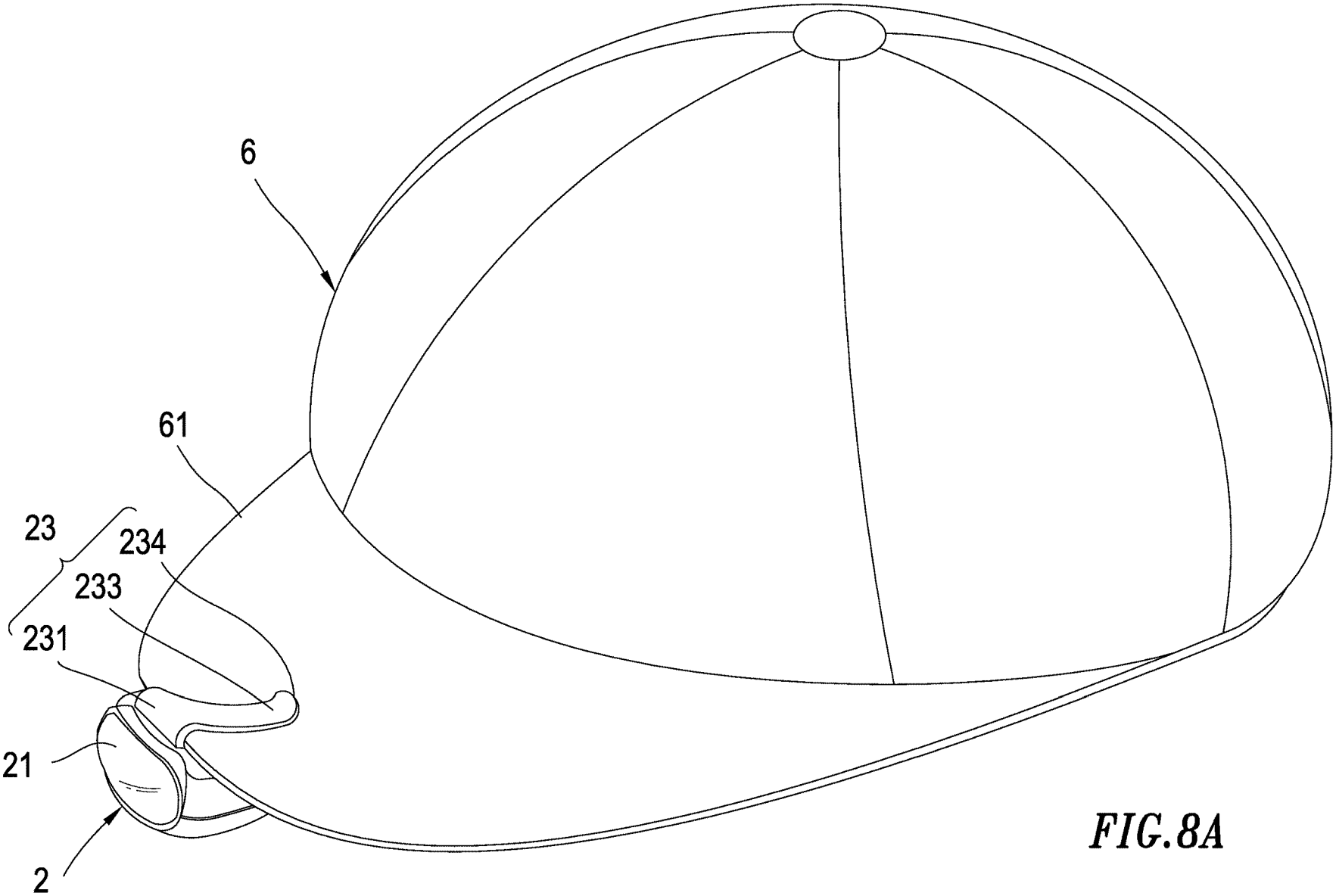
FIG. 8A shows a stereo view of the battery clamp structure according to the present invention, in which the lamp is assembled at the front side of a cap.
Figure 8B:
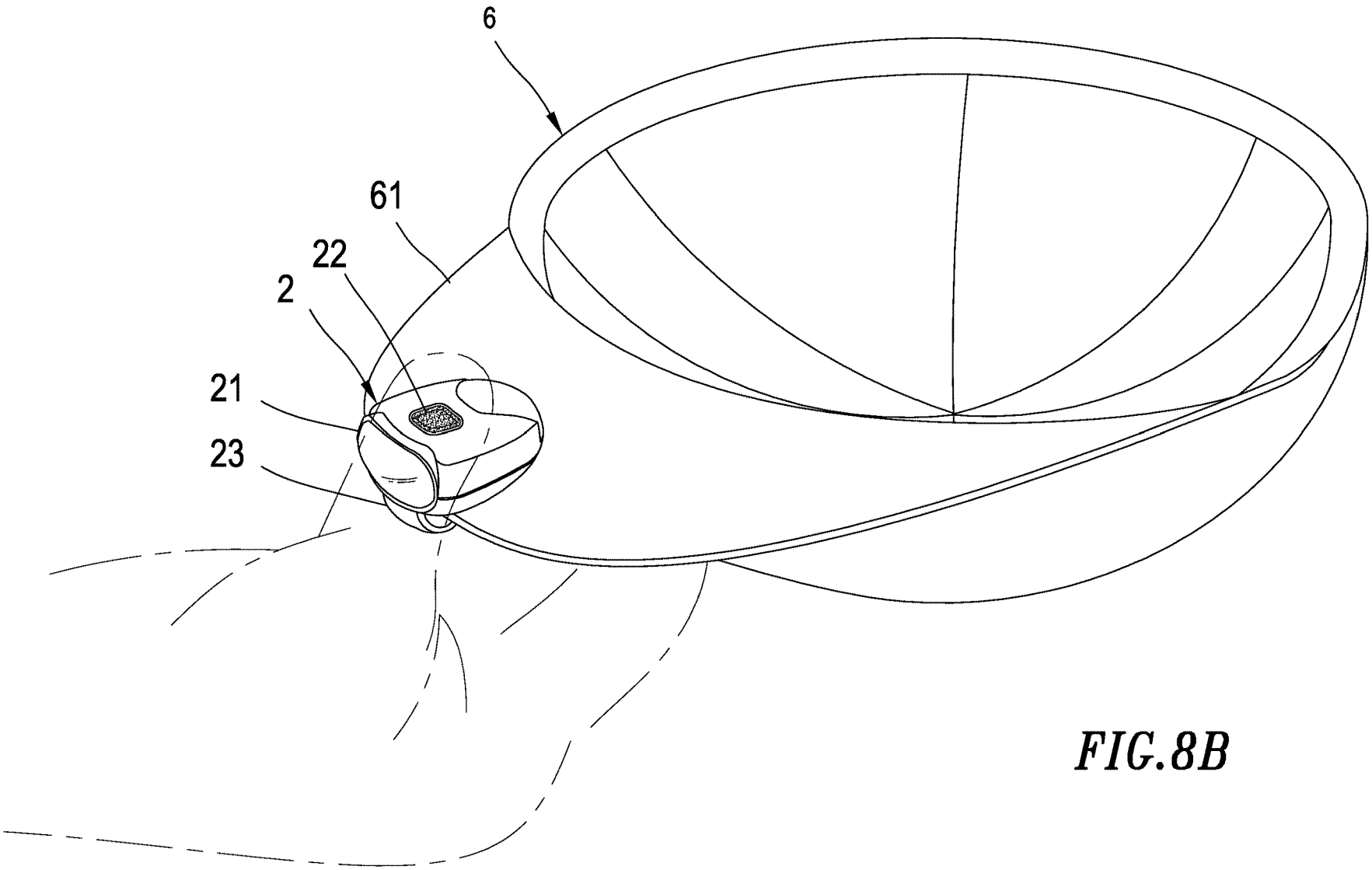
FIG. 8B shows a stereo view of the battery clamp structure according to the present invention, in which the lamp is assembled at the reverse side of a cap.

Next, referring to FIGS. 1 and 7, it can be appreciated that, when the lamp 2 is fixed onto the clamp head 12, the lighting portion 21 faces towards the clamp head 12, and in case of holding the grip 11 by means of the hand-holding portion and allowing the clamp head 12 to face towards the battery, the lighting portion 21 can cast light in the direction of the clamp head 12; besides, the lamp 2 can be also removed and clamped at other appropriate places through the clamp 23. Moreover, referring to FIGS. 8A and 8B, it can seen that, for example, the gripping segment 233 is clamped onto the cap edge 61 of a cap 6 and possibly act as a head lamp; in addition, when the lamp 2 is fixed onto the cap edge 61 and the switch 22 is located downwards, so that the user may pick up the cap edge 61 in accordance with the gesture, and simultaneously press the switch 22 with his/her thumb and then put on the cap 6.

Figure 9:
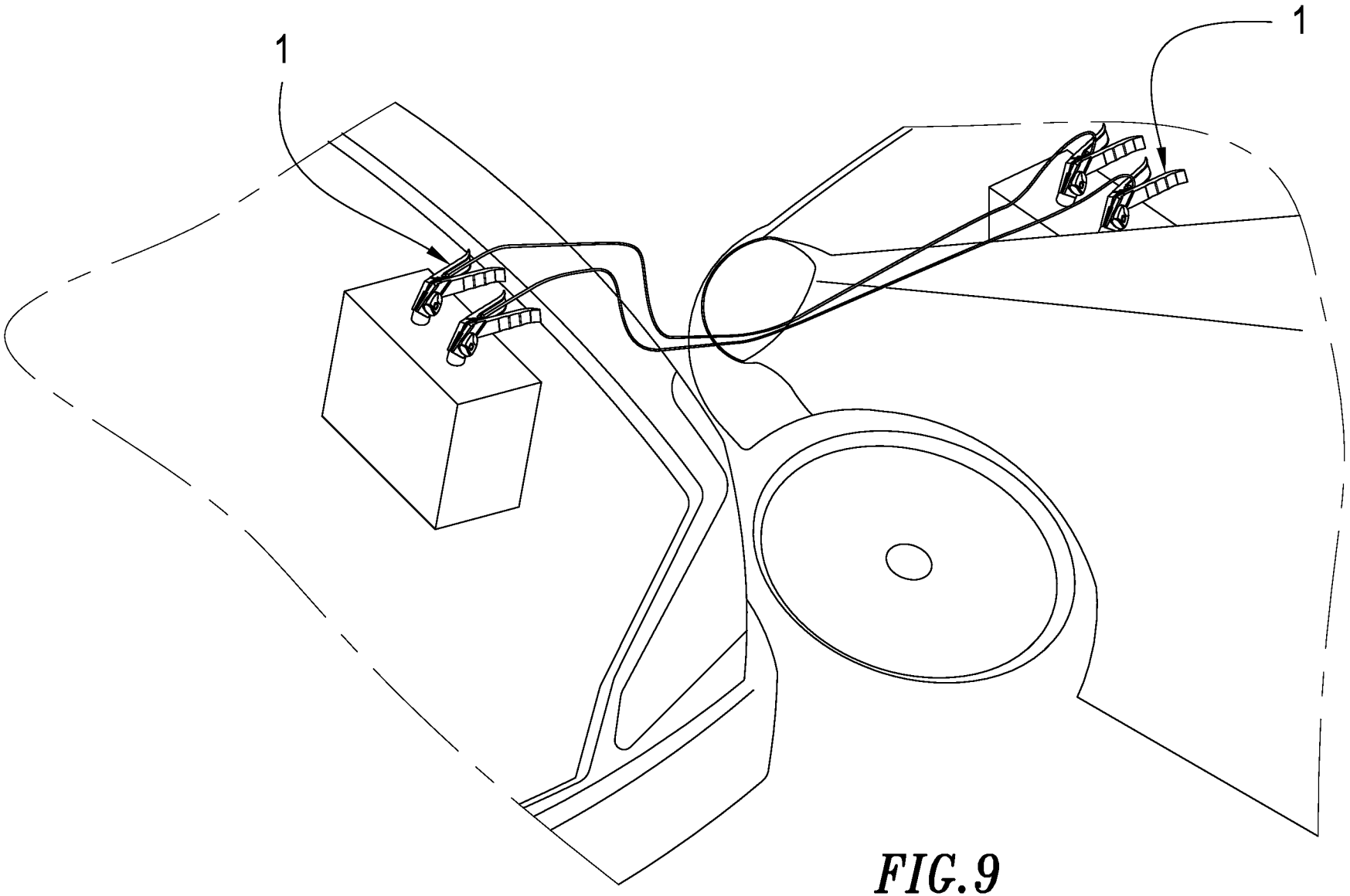
FIG. 9 shows an application view of the battery clamp structure according to the present invention, which is applied between two vehicles.

Referring now to FIG. 9, the illustrated embodiment demonstrates the implementation condition of a vehicle performing battery charging by means of another vehicle. Herein two battery clamps 1 are installed, while the other end is further set up with other two battery clamps 1, with each of such battery clamps 1 being respectively positive-negative clamped on the battery of the vehicle.

In comparison with other conventional technologies, the battery clamp structure of detachable lighting lamp according to the present invention provides the following advantages: the lamp is detachably installed on the battery clamp, so that, in addition to providing lighting when the battery clamp is in use, suppose the user needs to check or adjust other equipments while charging the battery of a vehicle, the lamp can be detached and fixedly clamped onto a cap or clothes by means of the clamp thereby enabling flexible operations. Therefore, it will be more practical in terms of use efficiency.

The present invention has been disclosed by means of the aforementioned embodiments which are merely certain preferred implementations of the present invention rather than being used to limit the scope thereof; those who are skilled in the relevant technical fields can, after understanding the technical features and embodiments of the present invention as explained hereinabove, certainly make equivalent changes, alterations or modifications without departing from the spirit and scope of the present invention, which are nonetheless deemed as falling within the coverage of the present invention; accordingly, the scope of the present invention to be protected by patent laws is subject to the definition of the claims attached to this specification.

What is claimed is:

1. A battery clamp structure of detachable lighting lamp, comprising:

a battery clamp, including two oppositely installed grips, with one end of each of the grips respectively having a clamp head, wherein the exterior of a clamp head is configured with a slide groove, an end of the slide groove towards the direction of the clamp head is formed with an abutting end, and the two sides of the slide groove respectively have a protruding rail;

a lamp, including a lighting portion, a switch and a clamp, in which an end of the clamp of the lamp towards the same side as the lighting portion is formed with a raised segment, the two sides of the raised segment are respectively configured with a recess portion, and a gripping segment close to the lamp is formed in extension from the raised segment;

accordingly, the clamp of the lamp can be detachably assembled within the slide groove such that, upon assembling, the raised segment can be embedded into the slide groove from the exterior of the clamp head thus allowing each protruding rail to be embedded into the recess portion in order to let the clamp of the lamp slide in the slide groove along the protruding rail and then slide to the abutting end at the raised segment to be fixed in place.

2. The battery clamp structure of detachable lighting lamp according to claim 1, wherein each of the clamp heads is inclined at a predetermined angle from one end of each of the grips such that an angle can be formed between each clamp head and each grip.

3. The battery clamp structure of detachable lighting lamp according to claim 1, wherein a bottom of the slide groove is configured to be inwardly inclined with respect to the abutting end such that the raised segment is attached to an inclined bottom of slide groove when the clamp of the lamp is assembled inside the slide groove.

4. The battery clamp structure of detachable lighting lamp according to claim 1, wherein a bottom of the slide groove includes a snap fixation groove and a tail segment is outwardly formed in extension from the gripping segment, such that the tail segment is snapped into the snap fixation groove for fixation when the clamp of the lamp is assembled inside the slide groove.

5. The battery clamp structure of detachable lighting lamp according to claim 1, wherein two battery clamps are configured, and each battery clamp is respectively connected to a wire which is further installed with a controller.

6. The battery clamp structure of detachable lighting lamp according to claim 5, wherein each wire is connectively installed within the clamp head not being openly configured with the slide groove.

7. The battery clamp structure of detachable lighting lamp according to claim 1, wherein each wire is connected to a power bank.

8. The battery clamp structure of detachable lighting lamp according to claim 7, wherein the power bank includes a light-emitting component.

9. The battery clamp structure of detachable lighting lamp according to claim 1, wherein two battery clamps are configured as a set, with one of said two battery clamps having the slide groove.

10. The battery clamp structure of detachable lighting lamp according to claim 1, wherein two battery clamps are configured as a set, with both of said two battery clamps having the slide groove.

* * * * *